US005806612A

United States Patent [19]

Vorhoff et al.

[11] Patent Number: 5,806,612

[45] Date of Patent: Sep. 15, 1998

[54] APPARATUS FOR THE TRANSMISSION OF INFORMATION IN A DRILL STRING

[75] Inventors: Werner Vorhoff, Wesel; Dieter Wrobel, Gelsenkirchen; Dagobert Feld, Lachendorf, all of Germany

[73] Assignees: DMT-Gesellschaft Fur Forschung Und Prufung MBH, Essen; Welldone Engineering GmbH, Beedenbostel, both of Germany

[21] Appl. No.: 805,408

[22] Filed: Feb. 24, 1997

[30] Foreign Application Priority Data

Feb. 28, 1996 [DE] Germany ..... 196 07 402.9

[51] Int. Cl.[6] ..... E21B 44/00; E21B 47/06

[52] U.S. Cl. ..... 175/40; 175/48; 367/83

[58] Field of Search ..... 175/40, 45, 48, 175/50; 367/80, 83

[56] References Cited

U.S. PATENT DOCUMENTS

| | | | |
|---|---|---|---|
| 4,078,620 | 3/1978 | Westlake et al. | 175/48 |
| 4,535,429 | 8/1985 | Russell et al. | 175/48 X |
| 4,553,226 | 11/1985 | Scherbatskoy | 175/40 X |
| 4,557,295 | 12/1985 | Holmes | 175/48 X |
| 4,784,229 | 11/1988 | Ostkamper et al. | 175/45 |
| 4,805,449 | 2/1989 | Das | 175/48 X |
| 5,583,826 | 12/1996 | Chin | 175/40 X |

*Primary Examiner*—Frank Tsay
*Attorney, Agent, or Firm*—Herbert Dubno

[57] ABSTRACT

In a drill string pressure pulses are generated by expansion and constriction of an elastic body to transmit information along the drill string.

12 Claims, 5 Drawing Sheets

APPARATUS FOR THE TRANSMISSION OF INFORMATION IN A DRILL STRING

SPECIFICATION

FIELD OF THE INVENTION

Our present invention relates to an apparatus for the transmission of information within a drill string and, more particularly, to a system in which information in the form of pressure pulses is transmitted by a liquid flowing through the drill string, especially the drilling liquid or mud, or some other flushing liquid. The system, therefore, can comprise a unit for producing the information along the drill string, e.g. at the drilling head or bit, and a system for converting the information to pressure pulses.

BACKGROUND OF THE INVENTION

It is known to transmit information along a flowing liquid by pressure pulses. Such systems have been found to be effective especially in the drilling field in order to transmit information regarding the state of the drilling head or bit and conditions in the vicinity thereof back to the surface through the flushing liquid which passes through the interior of the drill string. In such systems, the flushing liquid forms a data carrier.

At a location remote from the pulse generating unit, a receiving unit is provided which can include a pressure sensor and circuitry for decoding the received pressure pulses. This allows pressure pulses to transmit information as to the substantially instantaneous operating state of the drill head or bit to be communicated to the surface.

In the drilling field, various methods have been used for the transmission and reception of pressure pulses. For example, the information may be transmitted in the form of a pulse sequence or by variation of pulse amplitude. The negative or positive pulse technique can be used in which one generates and monitors a pressure rise or a pressure drop in the flushing liquid.

One system utilizing these principles is known from EP-A-0 290 939. In this case, the pressure pulses are generated substantially by operating a valve forming the pressure pulse generator in the flushing liquid. For this purpose, the valve can have a main valve body which is displaceable without seating or engagement of an abutment solely by the balance between forces operating on the valve member. An auxiliary valve is additionally provided as a so-called pilot valve which is controlled by the information generator and which acts via hydraulic forces on the main valve body to displace the latter. While there is no forcible contact between a moving member and a seat or other part in this system, and thus the valve operates free from shock, mechanical wear cannot be avoided since the system nevertheless requires relative displacement of rigid parts.

Because of the wear which thus results, replacement of parts is required in an expensive and time consuming operation. In addition, there are problems because the dimensions of the pulse generating system are relatively large and because the pulse generation operation then requires considerable energy.

DE PS 41 34 609 describes a device for generating pressure pulses in flowing media for the transmission of information, especially for the formation of bore holes in subterranean tunneling and mining operations, through the flushing passage of the drilling string. In the flushing passage of the drilling string a wheel or rotor can be provided which can be switched between generator and motor operation. This pressure pulse generating device has also been found to be effective but can be improved upon.

OBJECTS OF THE INVENTION

It is, therefore, the principal object of the present invention to provide an improved drill system for transmitting information which has the advantages of the systems described but is free from the drawbacks mentioned and others.

It is another objection of this invention to provide a device for the purposes described which can generate pressure pulses in a compact and economical matter, with minimum wear and at lower energy consumption and which also can be fabricated at low capitol cost.

Still another object of our invention is to provide a pulse generator for a drill system of the type described which has readily responsible parts, is subject to reduced wear, and in general, is free from prior art drawbacks.

SUMMARY OF THE INVENTION

These objects and others which will become apparent hereinafter are attained, in accordance with the invention, in a system of the type described wherein the pulse generator comprises an elastic flow resistance body in the flushing liquid stream and a setting or positioning device for varying the flow cross section of the flow resistance body in the cadence of the pressure pulses to be generated. The variation of the flow cross section is thus effected by a control or regulation, with or without feedback. Both types of variation of the flow cross section will hereinafter be referred to generically as "control".

According to the invention, in the liquid stream, usually the flushing liquid or drilling liquid stream, there is at least one flow resistant body which defines the variable flow cross section and by varying this flow cross section, pressure pulses are generated in the region of this body and behind the same with respect to the flow direction, these pressure pulses being propagated generally in the flow direction. These pressure fluctuations or pressure pulses can also be fed backwards in that, with a reduced flow cross section and a constant liquid volumetric flow rate, the flow velocity passed the resistant body is increased following which the liquid pressure partially drops. A reduction of the flow cross section gives rise to a partial pressure increase upstream thereof in the liquid stream. In this manner, desired pressure fluctuations or pressure pulses are generated in the liquid. It has been found that the elasticity of the resistance body permits generating the pressure pulses in a reproducible manner which, by comparison with earlier systems, is practically free from wear.

Furthermore, the reaction time of the elastic body is low so that inertial delays do not arise and the rising and fall flanks of the pressure pulse can be relatively steep and well defined. In this manner, the translation of information without distortion is possible even with the use of an elastic member.

Furthermore, since the pressure pulses have sufficient flank steepness and definition, digital analyzers can be used at the receiver end.

The device of the invention is very compact and comparatively inexpensive to fabricate, maintain and operate. Complex mechanical machining of the parts, as may be required for a valve body, can be eliminated. Finally, the amount of energy required to operate the pulse generator is substantially less than is the case with massive valve systems.

The drill system for transmitting information thus can comprise:

a drill string having a drilling head at a lower end thereof;

means for forcing a flushing liquid through the drill string into a borehole drilled thereby;

an information generator along the drill string;

a pulse generator in the drill string responsive to the information generator for producing pressure pulses in the liquid representing information to be transmitted by the information generator, the pressure pulses being propagated through the liquid, the pulse generator including at least one elastic flow resistance body defining a variable constriction in a path of the liquid flowing through the drill string, and a positioning device for actuating the body to vary a cross section of the constriction in a cadence of pressure pulses to be generated in the liquid; and receiving means spaced from the pulse generator along the path for detecting the pressure pulses and outputting signals representing information conveyed by the pressure pulses.

According to a feature of the invention, the elastic flow resistance body is a hollow body, for example, a hollow ball torus or hollow cylinder yet by concave constrictions. These permit simple and rapid well-defined changes in the flow cross section when expanded and constricted by the positioning device.

When the elastic member is formed from a plurality of hollow bodies, these can be actuated individually, collectively or alternatively by the positioning unit. In this manner, we are able to modify the shape of the pressure pulses, for example, the pressure pulse width. For instance, a pressure pulse with doubled pulse width can be easily and simply generated by providing two elastic hollow bodies as flow constrictors in the flow path. Both of these hollow balls can be controlled so that the cross section defined by one is first varied and the cross section defined by the other is then varied so that the pressure rises generated by them can overlap and a pulse of double width is produced.

The elastic bodies can be fabricated from rubber or an elastic synthetic resin, for example, an elastomer with a given Shore hardness. The flow resistance body can then have its yieldability and elasticity or consistency matched to the consistency or density of the liquid. By selecting the elasticity and shape of the resistance body, the pulse shape can be varied as well.

The positioning device can be mechanical, pneumatic or hydraulic and, in the case of a mechanical device, can engage the outer periphery of the elastic body and can press it together or pull it apart. The pneumatic actuation can be effected by inflating or expanding the body by means of compressed air and simply hydraulic pressure can be used to deform the body and effect a change in the flow cross section.

It has been found to be advantageous to provide the elastic body as a membrane which is fixed in the drill string and which can have an upper surface in contact with the periphery of the liquid stream traversing the drill string. The underside of the membrane can be actuated, e.g., by hydraulic pressure. The positioning device can be a servomotor directly acting upon the underside of the membrane, e.g. in the form of a hydraulic servomotor. The servomotor can also be a mechanical or electrical servomotor if desired.

Preferably, a pilot valve is provided in a bypass from an upstream side of the liquid path to a chamber behind the membrane.

Two such membranes can be provided opposite one another and the two bypass lines can be controlled by the valve which acts as a common valve for the two membranes. When a doubling of the pulse width is desired, the membranes can have separate pilot valves so that they can be actuated in succession rather than simultaneously to double the pulse width in the manner described.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
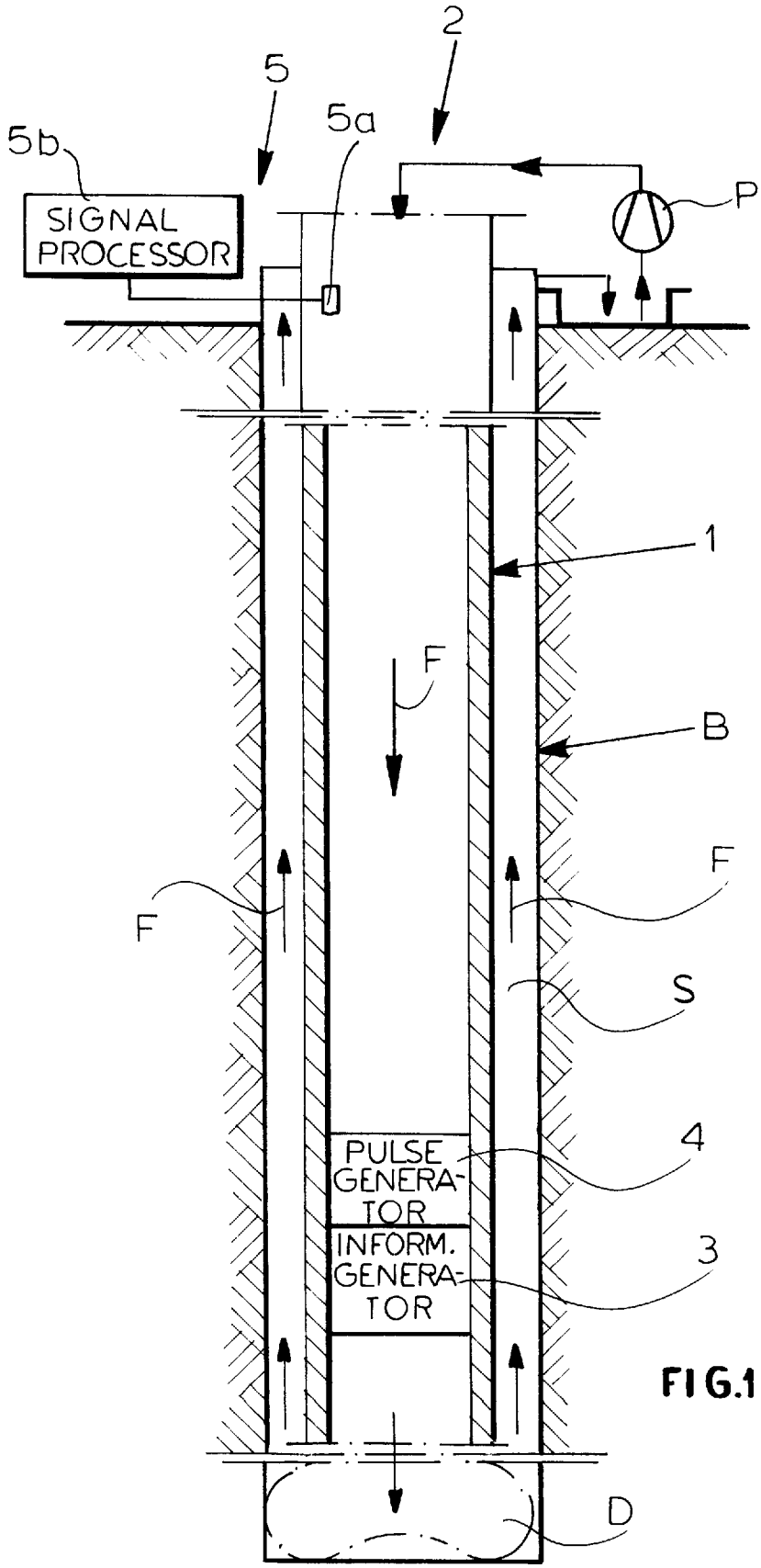
FIG. 1 is a vertical section showing a drill string utilizing the principles of the invention and in highly diagrammatic form.

FIG. 1 of the drawing shows that a drill string 1 of the drill system 2 can have, close to the drilling head or bit D in the bore hole B, an information generator 3 followed by a pulse generator 4 for producing pressure pulses in a flowing liquid, especially the drilling or flushing liquid F. The pressure pulses convey information via the liquid F, which functions as an information carrier, to a pressure sensor 5*a* of a receiving unit 5 at the surface. The receiver 5 also has a signal processor 5*b* for extracting the information from the pressure pulses.

The system can include a pump P for forcing the flushing liquid F down through the drill string 1 as represented by the arrows, to cool and lubricate the bit D at the head of the drill string 1, whereupon the fluid flows upwardly to carry off the drilling detritus in the formation of the bore hole. An annular clearance S is thus provided around the drill string and is traversed by the liquid.

The pressure pulses are generated by the pulse generator 4 which, according to the invention, includes an elastic body defining a flow cross section which can be varied by deforming that body elastically. This is described in detail in connection with FIGS. 2A through 2D, 3A, 3B and 4.

The information signals are generated by the information generator 3 and the pressure pulses are produced at the cadence of these information signals.

The information generator can produce an output representing such information as the operating state of the drill bit D or the drill head and details such as the inclination of the drill string, its roll angle, the temperature, the pressure, torque on the head or the instantaneous orientation of the drill head or the bit. This listing is not to be considered all inclusive since other valves or parameters of interest can be transmitted as well.

The pressure pulses which are produced are propagated through the liquid to the surface and are there detected by the sensor 5*a* and evaluated by the circuit 5*b* which decodes the pressure pulse information.

The pulse generating unit comprises (see FIG. 2A through 2D), an elastic body 6 forming a flow resistance in the drill string 1 and a positioning unit 7 for controlling the flow cross section Q defined in the string 1 in the cadence of the pulses received by the pulse generator from the information generating unit. The flow cross section can also be provided with a feedback regulation as desired.

FIGS. 2A through 2D show various embodiments of the elastic body 6.

Figure 2A:
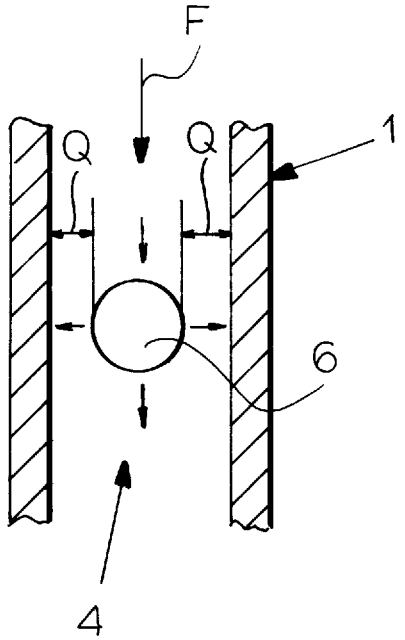
FIGS. 2A through 2D are detailed sections showing different configurations of flow resistance bodies according to the invention.

For example, in FIG. 2A the elastic body can be in the form of a hollow ball which can be expanded and contracted to vary the flow cross section Q. In FIG. 2B, that elastic body is a torus which, upon expansion, reduces the cross section Q within the torus as well as between the torus and the wall of the drill string 1.

Figure 2C:
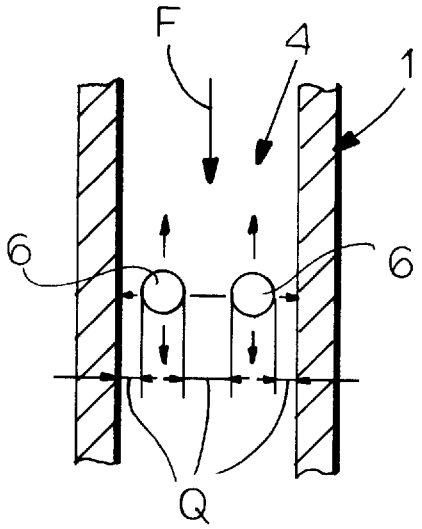
Figure 2B:
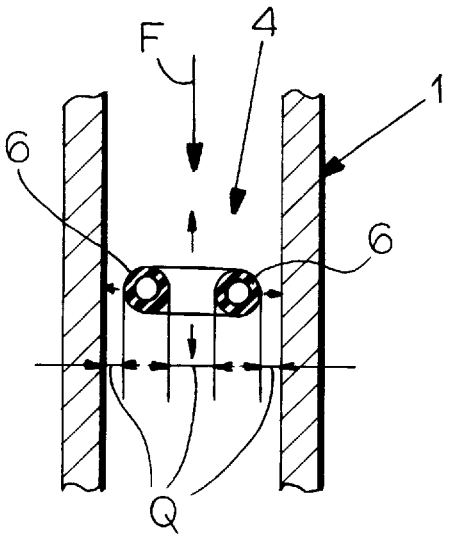

In FIG. 2C, an elastic element is formed by 2 hollow elastic bodies, namely, two balls which can be expanded one after the other in the manner described to produce a pressure pulse of double width.

Figure 2D:
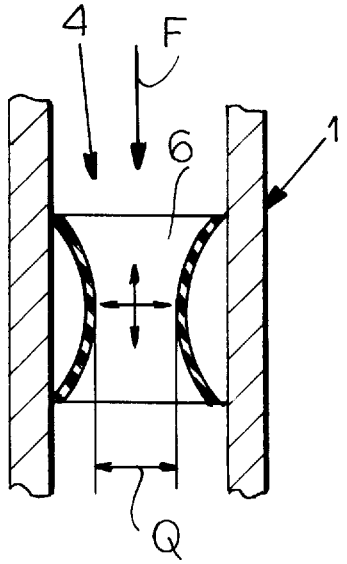

In FIG. 2D, the elastic body is a doubly curved structure forming a constriction at the center.

In all of the cases described, the flow resistant body 6 can be composed of rubber or an elastic synthetic resin such as an elastomer of a given Shore hardness.

Figure 3A:
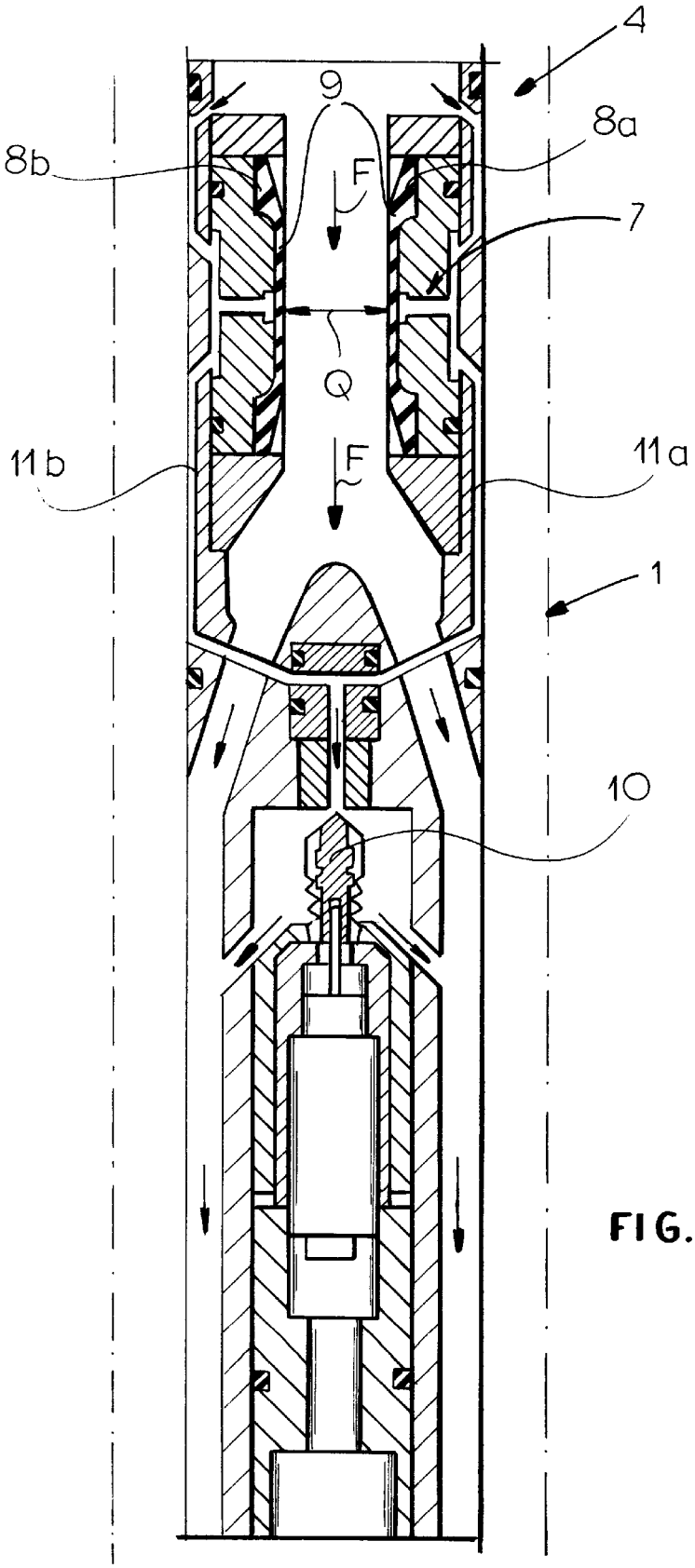
FIGS. 3A and 3B are axial sections through the pulse generating part of the drill string with the pilot valve in an open position in FIGS. 3A and in a closed position in FIG. 3B.
Figure 3B:
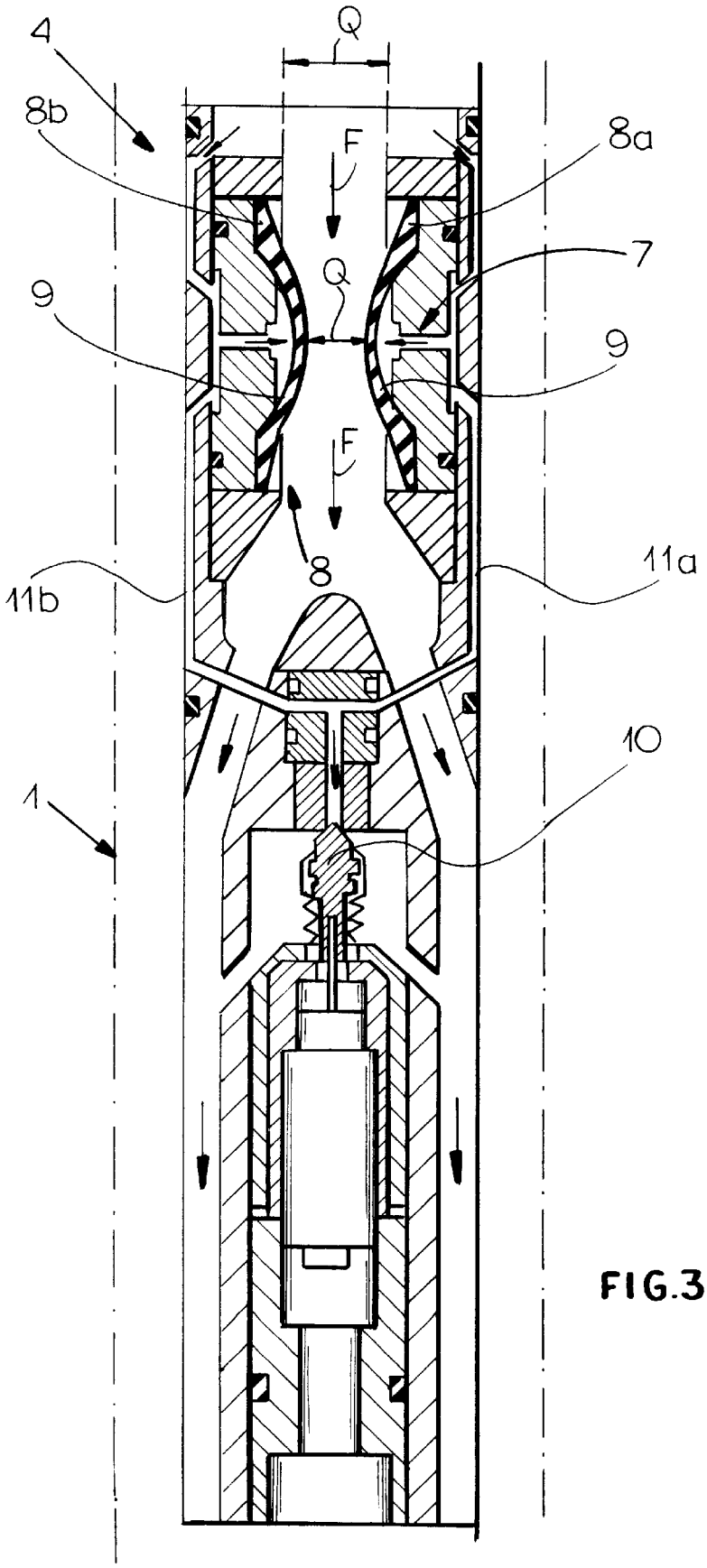
Figure 4:
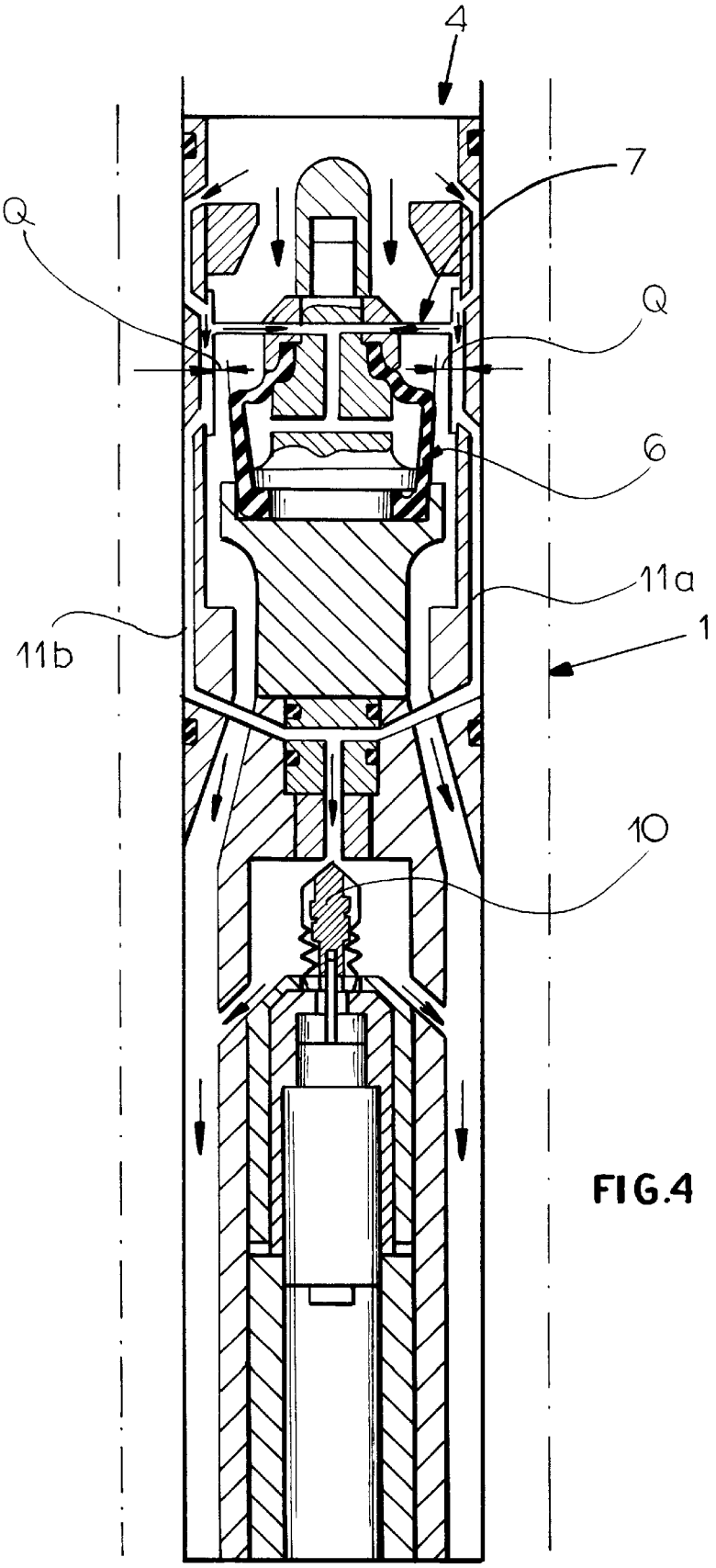
FIG. 4 is a vertical section through another drill string open in highly diagrammatic form and showing another embodiment of the system for generating the pulses.

The positioning device 7 can be mechanical, pneumatically or hydraulically actuatable or a combination of both. In FIGS. 3A, 3B and 4, the valve is a mechanical element participating in the hydraulic actuation of the elastic body. The elastic body may be a substantially cylindrical body as shown in FIG. 2D with a cross section varying along its length, or a body with axial symmetry as shown in FIG. 4.

Alternatively, a pair of membranes may be provided as has been shown in FIGS. 3*a* and 3B.

In this embodiment, the flow resistant body is formed by a pair of membranes 8 within the drill string 1 through which the flushing liquid flows in the direction of arrow F. The inner surfaces of the membrane 8, i.e. the surfaces facing inwardly, contact the flushing liquid F at the periphery of the upstream while the underside of each membrane 8 is acted upon by the positioning unit 7. In the embodiment shown, the positioning unit 7 includes a pilot valve 10 which controls a by-pass passage 11*a* or 11*b* for the liquid running from a high pressure upper side of a construction to a low pressure roller side thereof. In FIGS. 3A and 3B, moreover, two membranes 8*a* and 8*b* are provided and the two by-pass lines 11*a* and 11*b* are controlled by the common pilot valve 10.

In FIG. 3A, the membranes 8*a* and 8*b* are in their rest positions and the liquid passes substantially unhindered through the gap between the membranes. The bypass lines drain to the downstream side.

Application of a signal from the information generator 3 to press the valve 10 upwardly, blocks the bypass lines 11*a* and 11*b* to build up pressure above the membranes 8*a* and 8*b* so they are pressed inwardly (FIG. 3B) to reduce the flow cross section Q. The result is a generation of pulse which is transmitted through the liquid in the manner previously described. That pulse is detected by the sensor 5*a*.

In FIG. 4 another embodiment is shown in which the by-pass lines 11*a* and 11*b*, when blocked, cause pressurization of the hollow cylinder with by-concave constrictions. Again the expanding cylinder reduces the cross section Q when blocking of the bypass lines by the valve 10 causes pumping up of the hollow body.

We claim:

1. A drill system for transmitting information comprising:

a drill string having a drilling head at a lower end thereof;

means for forcing a flushing liquid through said drill string into a borehole drilled thereby;

an information generator along said drill string;

a pulse generator in said drill string responsive to said information generator for producing pressure pulses in said liquid representing information to be transmitted by said information generator, said pressure pulses being propagated through said liquid, said pulse generator including at least one elastic flow resistance body defining a variable constriction in a path of said liquid flowing through said drill string, and a positioning device for actuating said body to vary a cross section of said constriction in a cadence of pressure pulses to be generated in said liquid; and receiving means spaced from said pulse generator along said path for detecting said pressure pulses and outputting signals representing information conveyed by said pressure pulses.

2. The drill system defined in claim 1 wherein said body is an elastic hollow body which is selectively expanded and contracted to vary said cross section of said constriction.

3. The drill system defined in claim 2 wherein said elastic hollow body is selected from the group which consists of a hollow ball, a hollow torus and a hollow cylinder with biconcave curvature.

4. The drill system defined in claim 2 wherein said variable constriction is defined by a plurality of hollow bodies.

5. The drill system defined in claim 4 wherein said bodies are individually, collectively or alternatively controlled by said positioning device.

6. The drill system defined in claim 2 wherein said body is composed of rubber or an elastic synthetic resin.

7. The drill system defined in claim 6 wherein said synthetic resin is an elastomer of a predetermined Shore hardness.

8. The drill system defined in claim 2 wherein said positioning device includes at least one actuator selected from a mechanical, a pneumatic and a hydraulic actuator.

9. The drill system defined in claim 1 wherein said body includes a membrane exposed to said liquid along a periphery of a flow thereof through said drill string at one side of said membrane and actuated by said positioning device at an opposite side of said membrane.

10. The drill system defined in claim 9 wherein said positioning device includes a chamber closed by said opposite side of said membrane, a bypass passage connected from a location upstream of said body to said chamber, and a valve in said bypass passage.

11. The drill string defined in claim 10 wherein two of said membranes are provided opposite one another along said path, each of said membranes being actuated through a respective one of said bypass passages.

12. The drill string defined in claim 11 wherein both of said bypass passages are controlled in common by said valve.

* * * * *